US009517421B1

(12) United States Patent
Mae

(10) Patent No.: US 9,517,421 B1
(45) Date of Patent: Dec. 13, 2016

(54) DEVICE FOR FANCIFUL DETECTION OF GHOSTS

(76) Inventor: Maureen Mae, Springfield, TN (US)

( * ) Notice: Subject to any disclaimer, the term of this patent is extended or adjusted under 35 U.S.C. 154(b) by 415 days.

(21) Appl. No.: 13/314,558

(22) Filed: Dec. 8, 2011

(51) Int. Cl.
*A63H 33/00* (2006.01)

(52) U.S. Cl.
CPC ..... *A63H 33/00* (2013.01)

(58) Field of Classification Search
CPC ..... A63H 33/00; F21V 33/00; F21V 33/0008; A44C 15/0015
USPC ..... 446/14, 175, 484, 485, 491; 463/9
See application file for complete search history.

(56) References Cited

U.S. PATENT DOCUMENTS 2,707,769 A * 5/1955 Shaper ..... G01R 33/07 324/251
4,285,158 A * 8/1981 Courts ..... G01C 17/02 324/260
4,971,592 A * 11/1990 Carcia, III ..... A63H 33/30 428/3
5,434,500 A * 7/1995 Hauck ..... G01V 3/081 324/207.17
6,053,622 A * 4/2000 Horowitz ..... A47G 33/00 362/234
6,064,190 A * 5/2000 Suda ..... H04B 1/3838 324/149
6,091,238 A * 7/2000 McDermott ..... G01B 7/003 315/307
6,232,881 B1 * 5/2001 Suda ..... G01R 29/0878 324/149
6,288,498 B1 * 9/2001 Cheng ..... A44C 15/0015 315/185 S
6,329,924 B1 * 12/2001 McNulty ..... G01R 29/0857 340/552
6,755,199 B2 * 6/2004 Rehder ..... A61B 90/39 128/898
7,428,994 B1 * 9/2008 Jeffway, Jr. ..... A44C 15/0015 235/454
8,044,813 B1 * 10/2011 Dembo ..... G01R 29/0857 320/108
2006/0046606 A1 * 3/2006 Martin ..... A63H 30/00 446/166
2007/0121317 A1 * 5/2007 Huang et al. ..... 362/183
2007/0128975 A1 * 6/2007 Dimitriou ..... A63H 5/00 446/397
2009/0217702 A1 * 9/2009 Nagornova ..... A44C 15/0015 63/1.13
2011/0057583 A1 * 3/2011 Fattizzi ..... F21L 4/02 315/313
2011/0058363 A1 * 3/2011 Fattizzi ..... F21L 4/02 362/190
2011/0275315 A1 * 11/2011 Dembo et al. ..... 455/41.1

* cited by examiner

*Primary Examiner* — Gene Kim
*Assistant Examiner* — Alyssa Hylinski
(74) *Attorney, Agent, or Firm* — Stephen J. Stark; Miller & Martin PLLC

(57) ABSTRACT

A novelty toy, apparel, or jewelry, device for fanciful detection of ghosts, or other paranormal phenomena, through exploitation of Hall Effect, or of thermochromic material.

11 Claims, 4 Drawing Sheets

DEVICE FOR FANCIFUL DETECTION OF GHOSTS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of amusement and diversion and more specifically to a device for fanciful detection of ghosts.

Belief in ghosts, that is spiritual entities that leave the human body upon death, is virtually as old as the human race itself, and speculations about their nature and character are many and varied. Further, as a result of human imagination, countless legends, traditions, and tales regarding ghosts have become well known. They are said to be capable of interaction with the physical world and reportedly have on numerous occasions been seen and communicated with, as when the Witch at Endor called up a ghost of the prophet Samuel for King Saul.

Many people are fascinated by ghosts and occupy themselves with concocting and telling ghost stories and/or searching for ghosts. Accordingly, ghost hunting equipment and protocols abound.

The instant art is a toy, trinket, or curio, which, upon interacting with common and virtually ubiquitous, electromagnetic fields or temperature variations, both natural and man-made, emits an alarm indicative of this interaction. The imaginations of those perceiving said events may then relate them to the presence of ghosts and creatively concoct and/or act out scenarios based upon said suppositions. In this, the instant art offers a means of pleasant and enjoyable diversion to those fascinated by ghosts. Therefore, said instant art is a wanted and useful advancement of the art of amusement by exploitation of ghostly lore.

BRIEF SUMMARY OF THE INVENTION

A primary object of the invention is to serve as a toy, a curio, or a trinket that stimulates or focuses the imagination, regarding games relating to ghosts, or to ghost detection.

Another object of the invention is to provide a variety of perceivable effects which could be fancied to represent detection of paranormal entities or events.

Yet another object of the invention is detection of the presence of electromagnetic fields and exploitation of same to generate an electric current that powers a toy, curio, or trinket.

Another object of the invention is to sense transient variation of ambient temperature, and produce a perceptible response, thereto.

A further object of the invention is to comprise a device for decoration or adornment.

Another object of the invention is to exist in a form that can be incorporated in a variety of items, objects, jewelry, or apparel.

Another object of the invention is to be inexpensive and easy to manufacture.

A further object of the invention is durability.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine for fanciful detection of ghosts comprising: Hall Effect sensor, power source, housing, visual effect element, and electrical circuits.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

NUMBERED ELEMENTS

Figure 1:
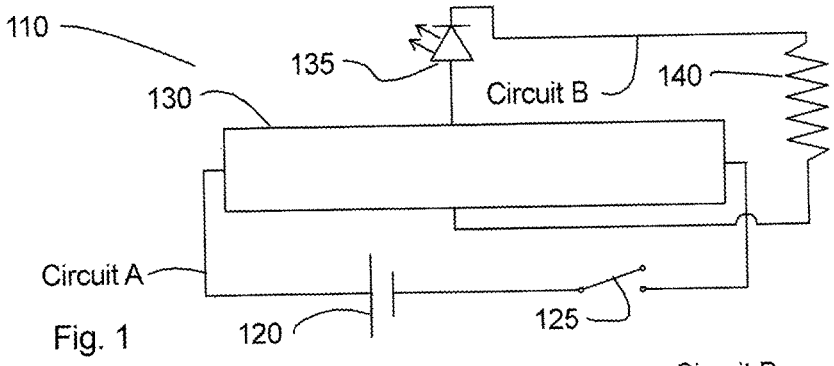
FIG. 1 is a schematic of elements of the toy, trinket, or curio.

110 Electromagnetic field detector
115 Fanciful ghost indicator
120 Power source
125 Switch
130 Hall Effect sensor
135 Light emitting diode
140 Resistor
145 Variable resistor
150 Heating element
155 Indicator body
160 Thermochromic element housing
162 Thermochromic element
165 Electromagnetic field detector housing
170 Setting

175 Pendant
180 Walking stick head
185 Bracelet
190 Breast Plate
195 Ring
200 Helmet
205 Garment
210 Data processing unit
215 Amplifier
220 Sound source
225 Ornamental or descriptive design
Circuit A
Circuit B

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

The instant art is predicated on popularly accepted notions that ghosts, or other paranormal events or entities, are often accompanied by slight variations in magnet fields, electromagnetic fields, or ambient temperature.

The instant art exploits the Hall Effect to produce an electric current that activates perceptible manifestations. The Hall Effect is well understood by those familiar with the art, and devices utilizing same, to produce electric current to detect, quantify, map, and/or otherwise describe electromagnetic fields are common. This technology is commonly employed in many fields and arts. The Hall Effect and its manner of use in relation to electromagnetic fields will therefore not be described in great detail but only to the extent necessary to teach use of the instant art.

FIG. 1 shows a diagram of an electromagnetic field detector (110) having a Hall Effect sensor (130) in circuit A with a power source (120) and manual switch (125). Thus, said Hall Effect sensor (130) may be activated, or deactivated. Also seen is circuit B, comprising the Hall Effect sensor (130), a light emitting diode (135), and a resistor (140).

Now, one familiar with the art will readily appreciate that when the switch (125) is closed and the Hall Effect sensor (130) activated, an electrical current in circuit B will be produced when said Hall Effect sensor (130) is properly oriented relative to flux lines of an electromagnetic field. Said electric current may then cause a light emitting diode (135) to emit light.

Also, if it is desired to prevent weaker electromagnetic fields from activating the light emitting diode (125), circuit B may comprise a resistor (140) to prevent weaker electric currents produced thereby from activating said light emitting diode (135). However, it may be readily appreciated that the device may function satisfactorily without the resistor (140).

Additionally, those well versed in the art will understand that the electric currents produced by some electromagnetic fields and the Hall Effect sensor (130) may be significantly small. In such instance, circuit B may comprise an amplifier (215), as seen in FIG. 1C, to increase said electric currents according to various predetermined ratios or not according to various ratios. Accordingly, different electric currents may, or may not, produce different amplifier (215) outputs.

Figure 1A:
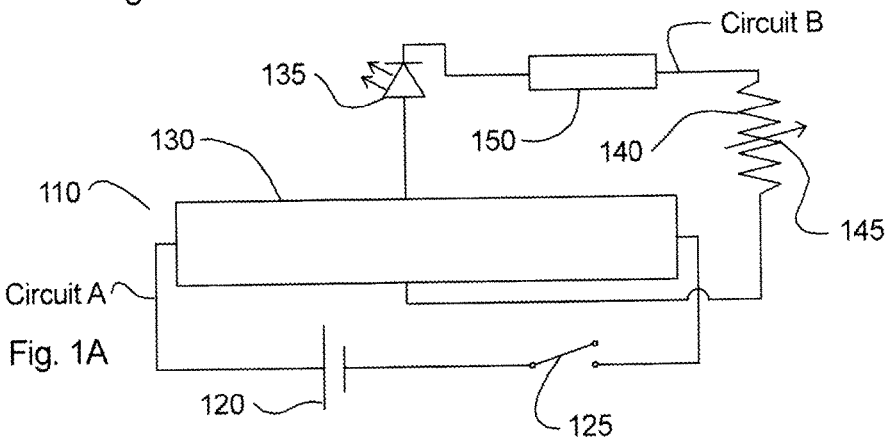
FIG. 1A is a schematic of elements of an alternate embodiment of the toy, trinket, or curio.
Figure 2:
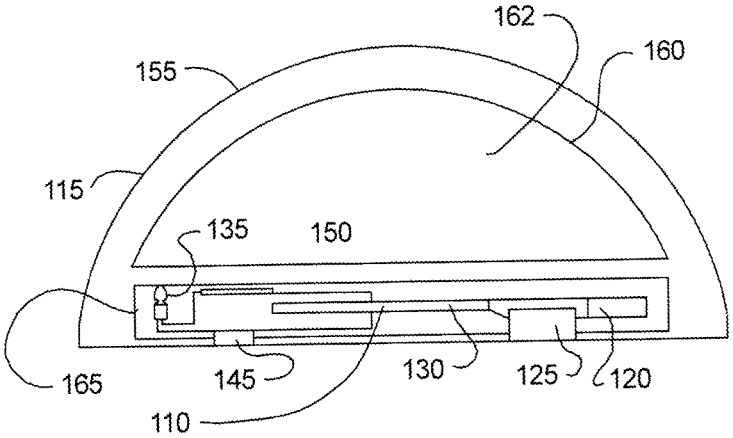
FIG. 2 is a side cross sectional view of the toy, trinket, or curio.

FIG. 1A shows that circuit B may also comprise a heating element (150). Thus, electric current produced by the Hall Effect sensor may cause output of both light and heat. Additionally seen in FIG. 2 is that circuit B may comprise a variable resistor (145) allowing the level of electric current required to activate the light emitting diode (135) and/or any other elements comprising circuit B to be varied or calibrated.

Figure 1B:
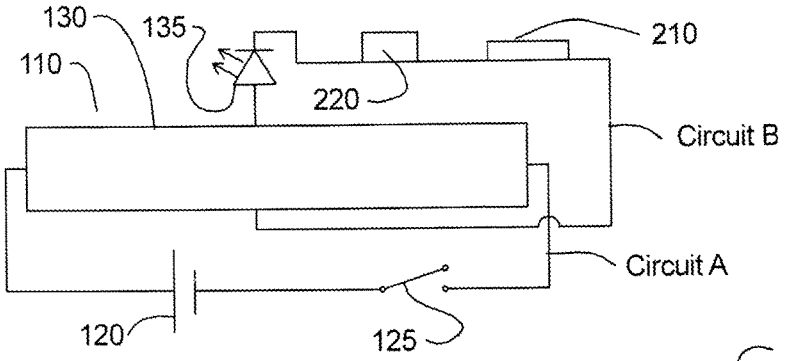
FIG. 1B is a schematic of elements of an alternate embodiment of the toy, trinket, or curio.
Figure 1C:
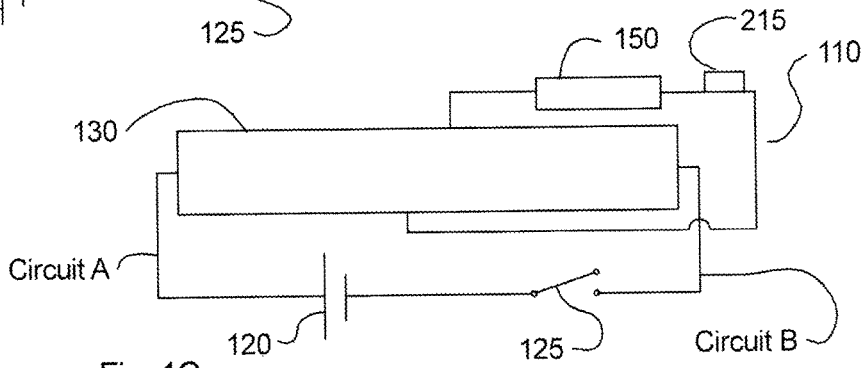
FIG. 1C is a schematic of elements of an alternate embodiment of the toy, trinket, or curio.

FIG. 1B shows that circuit B may comprise a data processing unit (210) which may control engagement of the light emitting diode (135) or any other element comprising circuit B. In example, the data processing unit (210) may be programmed to cause the light emitting diode (135) to flash intermittently in fixed or random patterns, or in response to given stimuli.

FIG. 1B additionally shows that circuit B may comprise an audio signal source which may be activated according to electrical signals produced by the Hall Effect sensor (130). Said sound intensity and/or frequency may vary according to the previously recited variation of electric current flowing through circuit B. Said different intensities and/or references may be taken by the user to indicate proximity of different types of ghosts, or paranormal conditions, or they may be otherwise interpreted according to the fancy of the user.

FIG. 1C is an embodiment wherein circuit B comprises a heating element (150) instead of a light-emitting diode.

In addition, one skilled in the art will readily appreciate that any elements comprising circuit B may be wired parallel to prevent failure of any particular element from shutting down the function of any other element.

FIG. 2 shows that a fanciful ghost indicator (115) mode may comprise an indicator body (155), which may be transparent or translucent, having an electromagnetic field detector housing (160). If translucent, the indicator body (155) may comprise a thermochromic element (162), the color of which varies with temperature. Also shown is the electromagnetic field detector (110) disposed in said housing (165) in such a way that the manual switch (125) may be accessed from outside the indicator body (155). Further, location of the variable resistor (145) permits access and adjustment from outside the indicator body (155).

Figure 3:
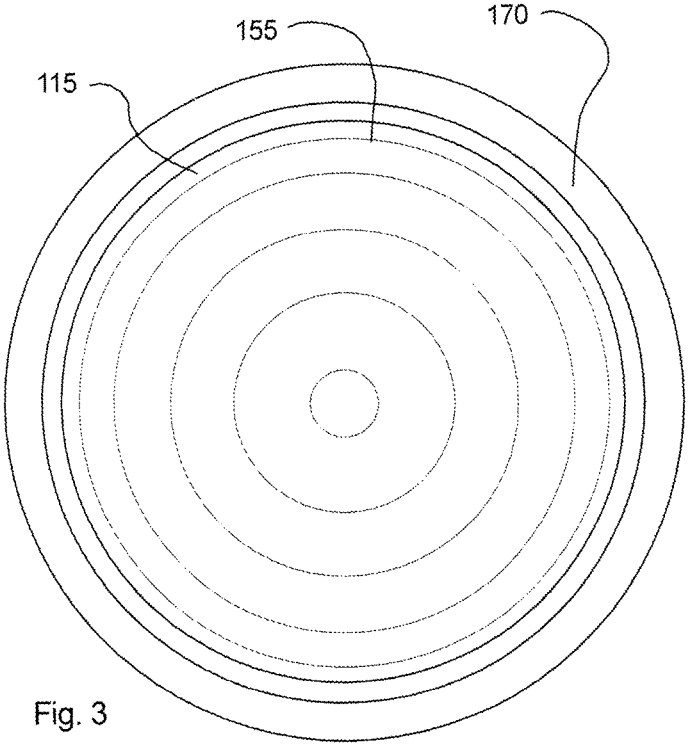
FIG. 3 is a top view of the toy, trinket, or curio.
Figure 4:
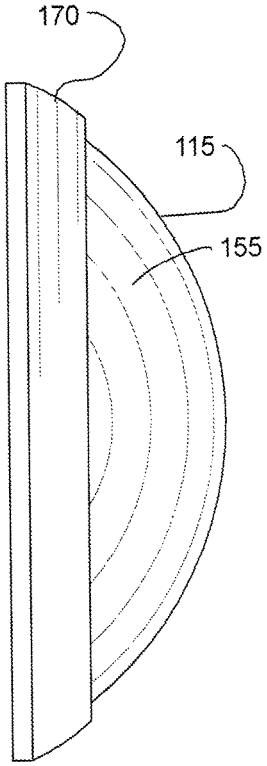
FIG. 4 is a side view of the toy, trinket, or curio.

FIG. 3 and FIG. 4 show that the fanciful ghost indicator (115) may comprise an ornamental setting (170) that may facilitate communication with other structures. FIGS. 2, 3, and 4 additionally show the fanciful ghost indicator (115) comprising an aesthetically appealing form, in example, that of a faux jewel or gemstone. However, one skilled in the art will readily appreciate that the fanciful ghost indicator (115) may comprise virtually any configuration that can be worn or carried.

One skilled in the art will readily appreciate that when an electromagnetic field is encountered by the Hall Effect sensor (130), the light emitting diode (135) is activated, light emitted thereby passing through the indicator body (155) and through which it may be viewed. Thus, according to the fancy of a user, such light might be said to be indicative of ghost presence and appropriate reactions may be imagined.

FIG. 2 also shows that the fanciful ghost indicator body (155) may also comprise a housing (160) for a thermochromic element (162) of any of sundry known types, in example liquid crystals which rearrange in response to temperature changes thusly changing light conductive properties and/or color of the thermochromic element (162). Now, one skilled in the art will understand that when the heating element (150) is disposed to communicate with the thermochromic element housing (160), as shown in FIG. 2, and is activated by production of electric current in the Hall Effect sensor (130), the various levels of heat produced thereby will be transferred to the thermochromic element (162) causing said element (162) to display various colors. This, according to the fancy of a user, might be said to be indicative of ghost presence and appropriate reactions may be imagined.

It may also be readily appreciated that in order to counteract influence of ambient air temperature and/or body heat upon the thermochromic element (162), the indicator body (155) may comprise thermally insulative properties. Alternatively, the indicator body (155) may be thermally non-insulative, such that the ambient air temperature may, in addition to, or in lieu of, the heating element, or of body temperature, affect the thermochromic element (162). Furthermore, the thermochromic element (162) and/or the indicator body (155) may comprise light diffusion qualities and/or prismatic qualities. Additionally, as is well known in the art, the thermochromic element (162) may be contrived not to change color outside a particular temperature range.

In addition, though the light emitting diode (135) and the heating element (150) are depicted in specific locations in FIG. 2, one skilled in the art will readily appreciate that said elements (135, 150) could be disposed at a variety of locations relative the electromagnetic field detector housing (165) simply by reconfiguring circuit B. Also, one skilled in the art will readily appreciate that Circuit B may comprise a light emitting diode only, a heating element only, or a sound emitting element only, or a combination of only two of these elements, and/or that circuit B may comprise any number of alternative perceivable event production elements, in example a vibrator.

Therefore, one skilled in the art will readily appreciate that the intensity of light visible through the indicator body (155) may vary according to factors such as intensity of the magnetic field encountered by the Hall Effect sensor (130) and/or the prismatic or light diffusion qualities of the thermochromic element (162). Also, the color of the thermochromic element (162) may vary according to temperature variations, in example variations of thermal energy from the heating element (150), or of the ambient temperature. Thus, the indicator body (155) may appear to glow or shine with varied intensities and/or colors. Said variations might be augured to indicate the presence of different types or characteristics of ghosts or other non-corporeal entities according to the fancy of the user.

Figure 5:
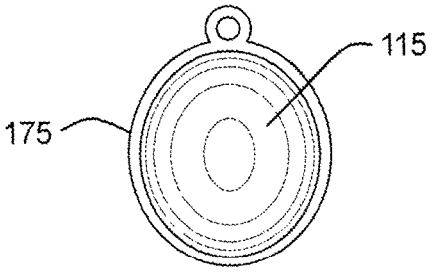
FIG. 5 is a view of the toy, trinket, or curio comprising a pendant or broach.
Figure 8:
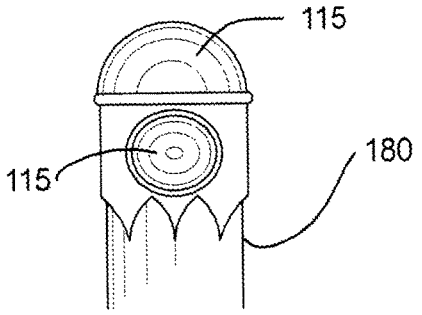
FIG. 8 is a view of the toy, trinket, or curio comprising a cane head, scepter, or baton.
Figure 6:
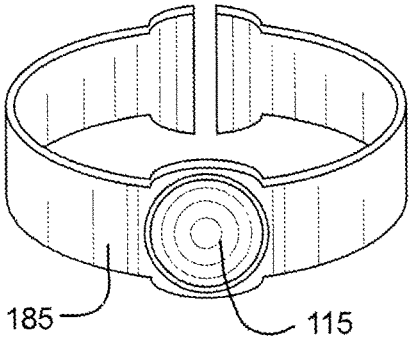
FIG. 6 is a view of the toy, trinket, or curio comprising a bracelet.
Figure 9:
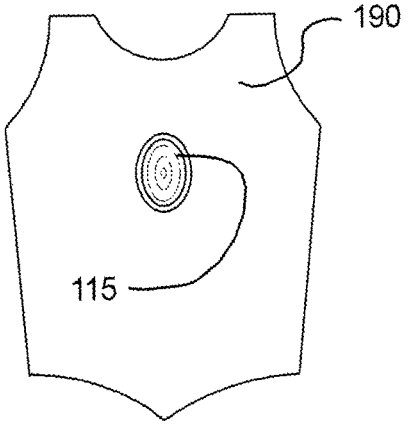
FIG. 9 is a view of the toy, trinket, or curio comprising a breast plate.
Figure 7:
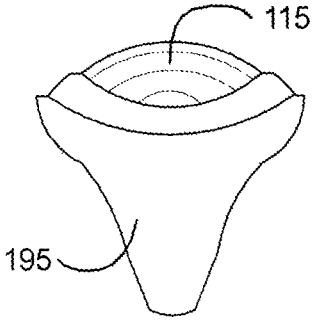
FIG. 7 is a view of the toy, trinket, or curio comprising a ring.
Figure 10:
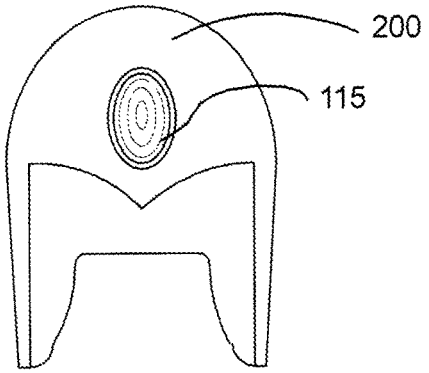
FIG. 10 is a view of the toy, trinket, or curio comprising a helmet.
Figure 11:
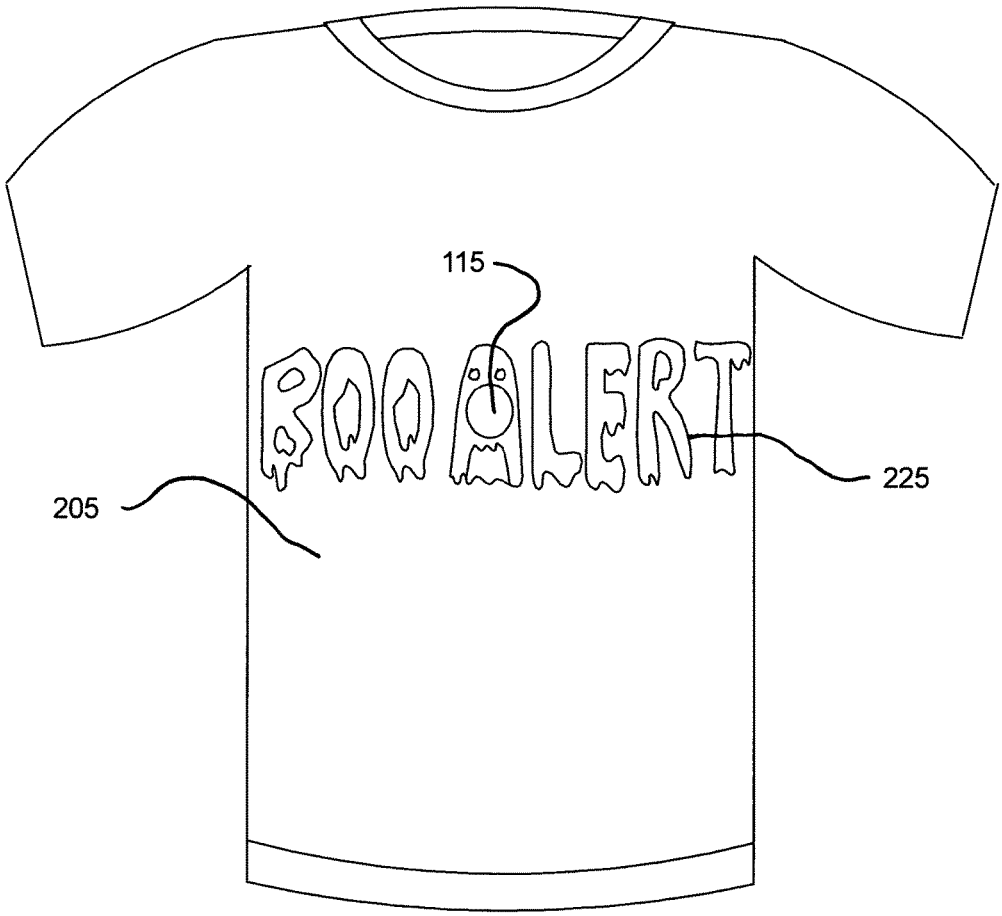
FIG. 11 is a view of the toy, trinket, or curio comprising a garment.

Now one skilled in the art will understand that the fanciful ghost indicator (115) may comprise forms suitable for incorporation into sundry items and/or designs, in example a pendant as in FIG. 5, a bracelet as in FIG. 6, a ring as in FIG. 7, the head of a walking stick as in FIG. 8, a breast plate, as in FIG. 9, and/or a helmet as in FIG. 10. FIG. 11 shows that the fanciful ghost indicator (115) may be incorporated into a garment (205) and/or ornamental or descriptive designs (225) thereupon.

While the instant art has been described in relation to imaginary ghost detection and games related thereto, it is not intended to be thusly limited. The function of the instant art lends itself to virtually unlimited imaginary roles, in example FIG. 9 might be said to represent an ephod and the instant art could be imagined to emulate the Urim and Thummim.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device that emits or displays one or more signals in response to stimulation, said device comprising:

a base of an ornamental setting, said base having an outer perimeter and supporting thereon and there above:

(a) an energy source;

(b) a stimuli detection element sensing magnetic fields with a Hall Effect sensor; and (c) a signal production element;

wherein said one or more signals are emitted or displayed through a translucent indicator body based on intensity of the sensed magnetic fields, said translucent indicator body connected interiorly of the outer perimeter of the base and spanning the ornamental setting with an outer perimeter of the translucent indicator body connected parallel to the outer perimeter of the base, with the signal production element providing generation and variation of light emission intensity or, alternatively or concurrently, variation of light emission color visible through the translucent indicator body based on intensity of the sensed magnetic fields; and wherein the stimuli detection element further comprises a thermochromic substance under the translucent indicator body and above the base.

2. A device that emits or displays one or more signals in response to stimulation, said device comprising:

a base of an ornamental setting, said base having an outer perimeter and supporting thereon and there above:

(a) an energy source;

(b) a stimuli detection element sensing magnetic fields with a Hall Effect sensor; and (c) a signal production element;

wherein said one or more signals are emitted or displayed through a translucent indicator body based on intensity of the sensed magnetic fields, said translucent indicator body connected interiorly of the outer perimeter of the base and spanning the ornamental setting with an outer perimeter of the translucent indicator body connected parallel to the outer perimeter of the base, with the signal production element providing generation and variation of light emission intensity or, alternatively or concurrently, variation of light emission color visible through the translucent indicator body based on intensity of the sensed magnetic fields; and wherein the signal production element further comprises a thermochromic substance located under the translucent indicator body and above the base.

3. The device as in claim 2, wherein the signal production element further comprises a heating element in communication with said thermochromic substance.

4. The device as in claim 2, wherein the signal production element further comprises a vibrator.

5. A device that emits or displays alarms in response to stimulation, said device comprising:

a base of an ornamental setting, said base having an outer perimeter and internally supporting thereon and there above:

(a) an energy source;

(b) a means of stimulus detection; and (c) a means of emitting or displaying an alarm;

wherein said means of emitting or displaying an alarm comprising means of generation and emission of light, with variation of light emission intensity and/or color based on variation of magnitude of a detected stimulus, said means of stimulus detection comprising at least a Hall Effect sensor;

said means of emitting or displaying an alarm comprising an electrically activated or excited luminous sensing magnetic fields device, and also comprising a thermochromic substance located between the base of the ornamental setting and a translucent indicator body having an outer perimeter parallel to the outer perimeter of the base of the ornamental setting and located internally of the outer perimeter of the base.

6. The device as in claim 5 wherein the means of emitting or displaying an alarm further comprises a heating element.

7. The device as in claim 5 wherein the means of emitting or displaying an alarm further comprises an audio signal generator.

8. The device as in claim 5 wherein the means of emitting or displaying an alarm further comprises a, below audio frequency, vibration generator.

9. A device that emits a signal in response to stimulus, said device comprising;

an ornamental device having a base with an outer perimeter;

a stimulus detection element comprising a Hall Effect sensor sensing magnetic fields;

a signal generation element comprising a light emitting diode emitting a varying output based on a magnitude of the sensed magnetic field; and a power source on top of the base;

a thermochromic element located above the base;

a translucent housing having an outer perimeter connected to the base and encapsulating the thermochromic element between the translucent housing and the base with the outer perimeter of the housing connected internally and parallel to the outer perimeter of the base; and a current amplifier, or a voltage amplifier connected to the power source.

10. The device as in claim 9, also comprising a heating element.

11. The device as in claim 9, also comprising a microprocessor.

* * * * *